US006334237B1

(12) United States Patent
Tsuzuki

(10) Patent No.: US 6,334,237 B1
(45) Date of Patent: Jan. 1, 2002

(54) SLIVER ACCOMMODATION-CONICAL METHOD AND DEVICE

(75) Inventor: Kiyohiro Tsuzuki, Greenville, SC (US)

(73) Assignee: KITI International Corporation, Greenville, SC (US)

( * ) Notice: Subject to any disclaimer, the term of this patent is extended or adjusted under 35 U.S.C. 154(b) by 0 days.

(21) Appl. No.: 09/544,389

(22) Filed: Apr. 6, 2000

(30) Foreign Application Priority Data

Apr. 7, 1999 (JP) ..... 11-099550

(51) Int. Cl.[7] ..... D04H 11/00

(52) U.S. Cl. ..... 19/159 R; 19/149; 19/150; 19/157; 242/362

(58) Field of Search ..... 19/65 A, 149, 19/150, 157, 159 A, 159 R; 57/90, 281; 242/362, 362.1, 362.2, 362.3

(56) References Cited

U.S. PATENT DOCUMENTS 4,709,452 A * 12/1987 Cooley et al. ..... 19/159 R
5,237,726 A * 8/1993 Gartenmann et al. ..... 19/159 R
5,450,656 A * 9/1995 Ueding et al. ..... 19/159 R
5,561,889 A * 10/1996 Leifeld ..... 19/159 R
5,575,040 A * 11/1996 Leifeld et al. ..... 19/159 A

* cited by examiner

*Primary Examiner*—Danny Worrell
*Assistant Examiner*—Gary L. Welch
(74) *Attorney, Agent, or Firm*—John B. Hardaway, III; Nexsen Pruet Jacobs & Pollard, LLC

(57) ABSTRACT

This invention relates to a method and apparatus for loading sliver onto a sliver tray placed in a designated location in a semi-truncated conical shape without using spindles. This invention enables sliver S spun out of a coiler system C to be accommodated in a semi-truncated conical shape and loaded onto the sliver tray T, which was already placed in a designated location. The device enables the accommodation of sliver S to be formed in a semi-truncated conical shape capable of standing independently and without requiring the use of spindles. The coiler system C has been removed from the drawing frame 11 so that the device is able to move in three directions X, Y, Z either front/rear, left/right, and upward/downward. These three directions can cross one another at right angles. When the upward/downward direction of the coiler system C is stopped, and the coiler system C is allowed to move alternately in two different directions front/rear, left/right and by changing the moving length making it either longer or shorter, and by lifting the coiler system C to a designated height after each layer is completed and by then repeating the same operation for the next layer, the sliver S will be accumulated into layers with a designated pressure against already loaded sliver S forming a semi-truncated conical shape on the sliver tray T.

15 Claims, 14 Drawing Sheets

SLIVER ACCOMMODATION-CONICAL METHOD AND DEVICE

FIELD OF THE INVENTION

This invention is the sliver accommodation method and device. The invention allows sliver to be spun out of a drawing frame and loaded onto the sliver tray located in a designated location to form a semi-truncated conical shape without requiring the use of spindles.

This invention relates to the accommodation method of sliver, and how sliver is continuously spun out of a revolving coiler system, placed in the downstream of the draft part, into a loaded condition onto a sliver tray which is waiting in a designated location.

BACKGROUND OF THE INVENTION

The common industrial method currently in use is to take sliver spun out of the drawing frame and to place it on a spindle. This conventional method using spindles has two types, the rod type and the square type. The rod type method uses a spinning motion or a combination of a spinning and/or a circular motion to accommodate the sliver inside. The square type method uses a square motion to accommodate the sliver inside. The previously mentioned conventional methods require a large number of spindles and extras. A large number of spindles require a high initial capital investment. The large number of spindles correspondingly requires a large space to store the empty spindles. These conventional methods have a further disadvantage of requiring a high output of energy to transport the spindles.

Another conventional method still in use is to transport sliver in a coiled condition on a hanger. The advantage of this method over other methods was in not requiring the above-mentioned spindles, however, the hanger method will not hold as much volume and still requires the transportation of the hangers.

SUMMARY OF THE INVENTION

This invention presents a new method and device of accommodating sliver into a semi-truncated conical shape on the sliver tray placed in a designated location without using spindles. The current invention overcomes problems inherent in the [mentods] methods and apparatus currently known to the art by providing a sliver accommodation method comprising receiving sliver upon a sliver receiving tray, moving the tray up and down, moving the tray left and right, and moving the tray forward and backward to accumulate sliver into layers with a predetermined pressure against previously received sliver forming a semi-truncated conical shape of sliver.

Figure 1:
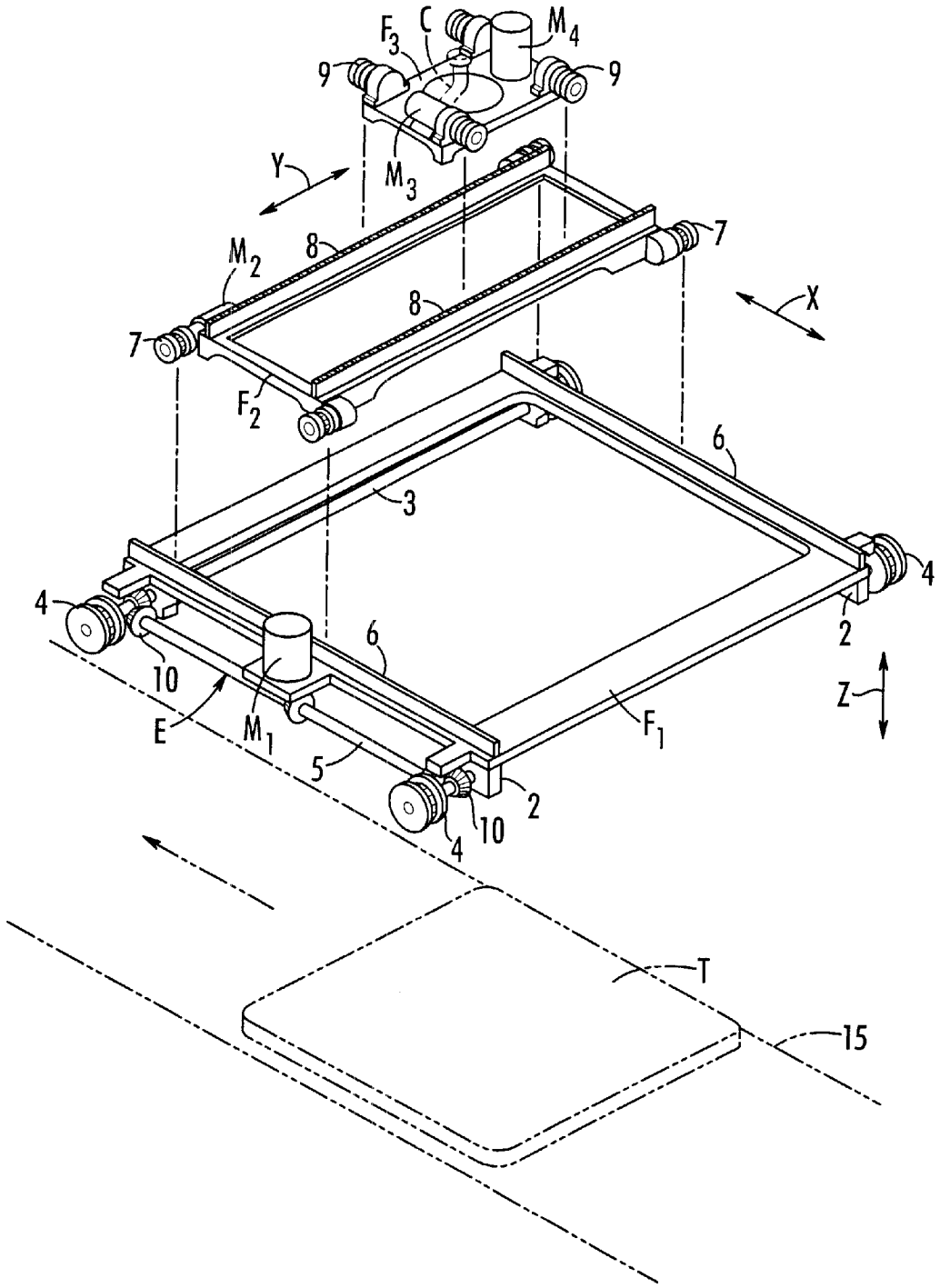
FIG. 1 is an oblique disassembled drawing of the sliver accommodation device A.

Explanation of symbols used in the drawing figures:

A: Sliver accommodation device

C: Coiler system

D: Draft part $F_1$: Mainframe $F_2$: Front/rear moving inner frame (the first or the second inner frame)

$F_3$: Left/right moving inner frame (the first or the second inner frame)

S': Sliver

S: Loaded sliver $M_1$: The first mot or (the first driving means)

$M_2$: The second motor (the second driving means)

$M_3$: The third motor (the third driving means)

T: Sliver tray

X: Front/rear direction

Y: Left/right direction

Z: Upward/downward direction

11: Frame

15: Transporting conveyor

DETAILED DESCRIPTION OF THE INVENTION

Using this invention where the coiler system is separated from the drawing frame, the coiler system will now gain new capability to move in three different directions. The three directions will cross one another at right angles. The three different directions are the front/rear, left/right, and upward/downward. When the upward/downward direction movement is stopped and when the movement of the coiler system is alternately in two different directions, front/rear direction and left/right direction, and then by changing the moving length either longer or shorter, and by lifting the coiler system to a designated height after each layer is complete and by repeating the same operation for the next layer, the sliver will be accumulated into layers with a designated pressure against the already loaded sliver forming a semi-truncated conical shape on the sliver tray.

The sliver accommodation method mentioned above has a special characteristic regarding the loading system, which starts the loading process from the bottom layer and from the outer circle of the sliver tray.

This device has a special characteristic that will accommodate sliver, which is continuously spun out of the revolving coiler plate, in a loaded condition onto the sliver tray placed in a designated location. The device is equipped with three frames, the main frame, the first inner frame, and the second inner frame. The main frame is located directly above the aforementioned sliver tray with the first driving means to provide the upward/downward direction movement. The first inner frame has the capability of moving to the front/rear direction or left/right direction by using a second driving means. The second inner frame has the capability of moving horizontally in a direction that is crossing at a right angle to the movement of the first inner frame. The aforementioned coiler system is attached to the aforementioned second inner frame apart from the drawing frame, and can move alternately in two different directions either front/rear or left/right by using both the second driving means and the third driving means previously mentioned. The device will enable sliver being spun out of the coiler system to accumulate in layers on the sliver tray. The coiler system will be lifted to a designated height every time a new layer is complete resulting in sliver being accumulated into layers with a designated pressure against already loaded sliver and forming a semi-truncated conical shape on the sliver tray.

The sliver accommodation device previously mentioned includes a special characteristic of the sliver tray being placed in a designated location on the transporting conveyor for loading. When the sliver tray in this designated location has completed loading it automatically moves forward with the sliver on the sliver tray able to independently remain standing on its own.

This invention is made to solve the above-mentioned problems with the conventional methods. In this invention, the following special characteristics exist to accommodate sliver, which is continuously spun out of a revolving coiler system located in the downstream of the draft part by loading the sliver onto the sliver tray, which was placed in a designated location, in such a manner that the sliver is loaded in a semi-truncated conical shape. In this invention the coiler system, by being removed from the drawing frame, will have a capability to move in three different directions. The three directions are the front/rear direction, left/right direction, and upward/downward direction. The three directions can cross one another at right angles to achieve the accumulation of sliver being spun out of the coiler system in layers on the sliver tray. When the upward/downward direction movement is stopped, moving the coiler system alternately in two different directions, the front/rear direction or the left/right direction and by changing the moving length longer or shorter, and by lifting the coiler system to a designated height after each layer is complete and by repeating the same operation for the next layer, the sliver will be accumulated into layers with a designated pressure against already loaded sliver forming a semi-truncated conical shape on the sliver tray.

When the coiler system is located at the proper height from the sliver tray (the height that sliver will be spun out of the coiler plate and will be loaded with a designated pressure against already loaded sliver on the sliver tray), it will let sliver be loaded onto the entire surface of the sliver tray to form the bottom layer using the movements alternately in two different directions. These two directions of movement are the front/rear direction and the left/right direction. There are two types of loci drawn by the coiler system on the sliver tray. The first locus occurs when sliver will start loading from the outer circle of the sliver tray towards the center of the sliver tray by moving in a front/rear direction and a left/right direction while gradually reducing the length of the movement. The second locus occurs when sliver will start loading from the center of the sliver tray toward the outer circle of the sliver tray by moving in a front/rear direction and a left/right direction while gradually increasing the length of the movement.

After the loading of the bottom layer is complete, the coiler system will be lifted to a designated height, thereby drawing a different locus, and will then form the second layer. By repeating the same procedure, additional layers will then be added. As the coiler system goes higher, the maximum moving length of the front/rear and left/right movements will gradually shorten, and ultimately the sliver will be loaded in a semi-truncated conical shape on the sliver tray. Because the sliver being spun out retains the proper pressure against the already loaded sliver, and because this loaded sliver is formed in a semi-truncated conical shape with a specific inclination on all sides, there is little possibility of the sliver collapsing.

As new layers are added, by changing the pitch of the maximum moving length of the front/rear movement and the length of the left/right movement to a shorter movement (a gradual degree of reduction of the maximum moving length), the entire shape of the loaded sliver on the sliver tray can be changed. Also, by changing the moving speed of the loading coiler system either moving front/rear and/or left/right, the density of the loaded sliver can be changed. Because the coiler plate, a part of the coiler system, changes its location in relation to the downstream of the draft part of the drawing frame every moment, the length of sliver hanging between them will also correspondingly change. Due to this effect, the revolution of the above mentioned coiler plate is controlled by a control motor such as a servomotor. The servomotor will change the revolution in harmony with the hanging length of the sliver. This will make it easier for the sliver to spin out of the coiler plate without having a drastic change in the tension of the hanging sliver, which will then make the entire process much smoother.

Figure 2:
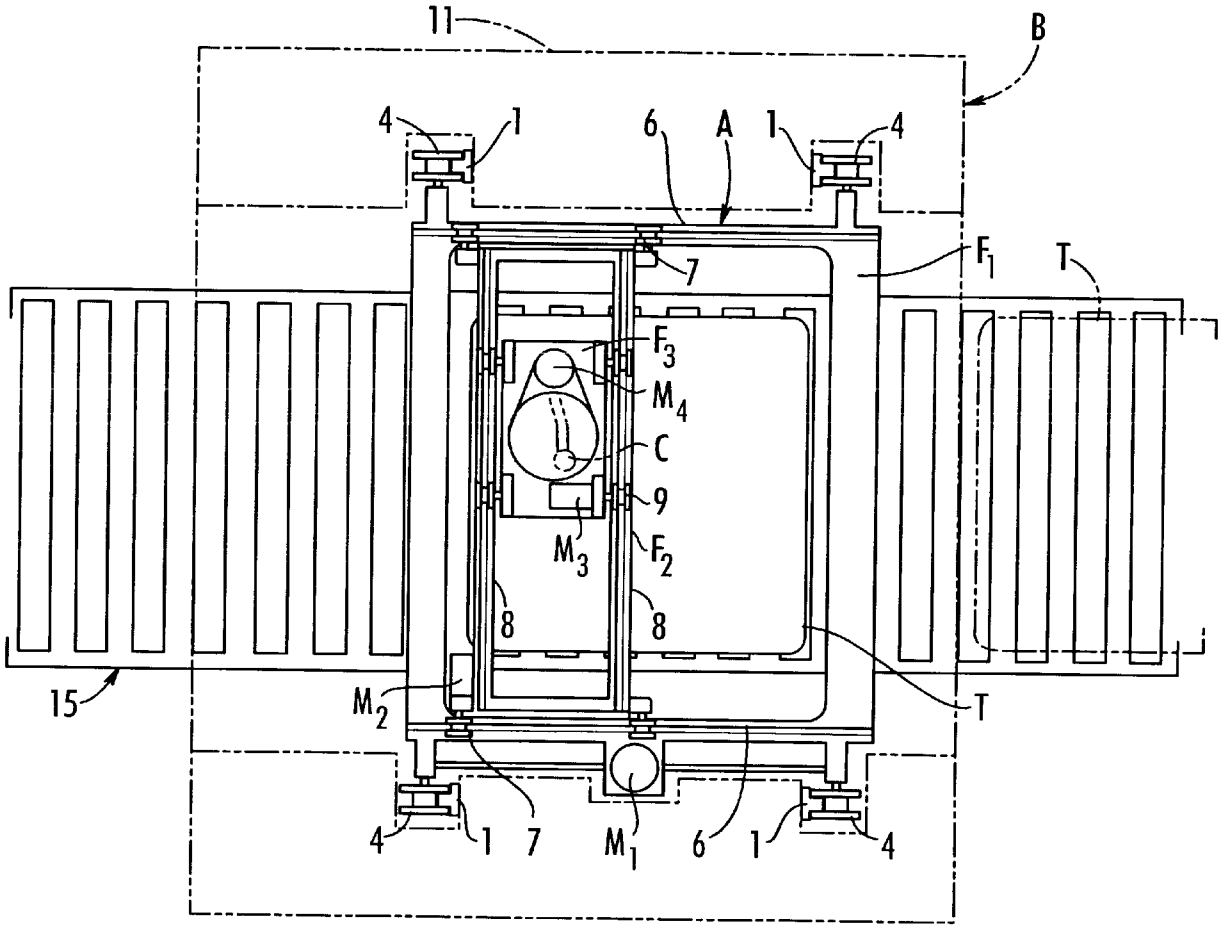
FIG. 2 is a top view of the accommodation device A.
Figure 3:
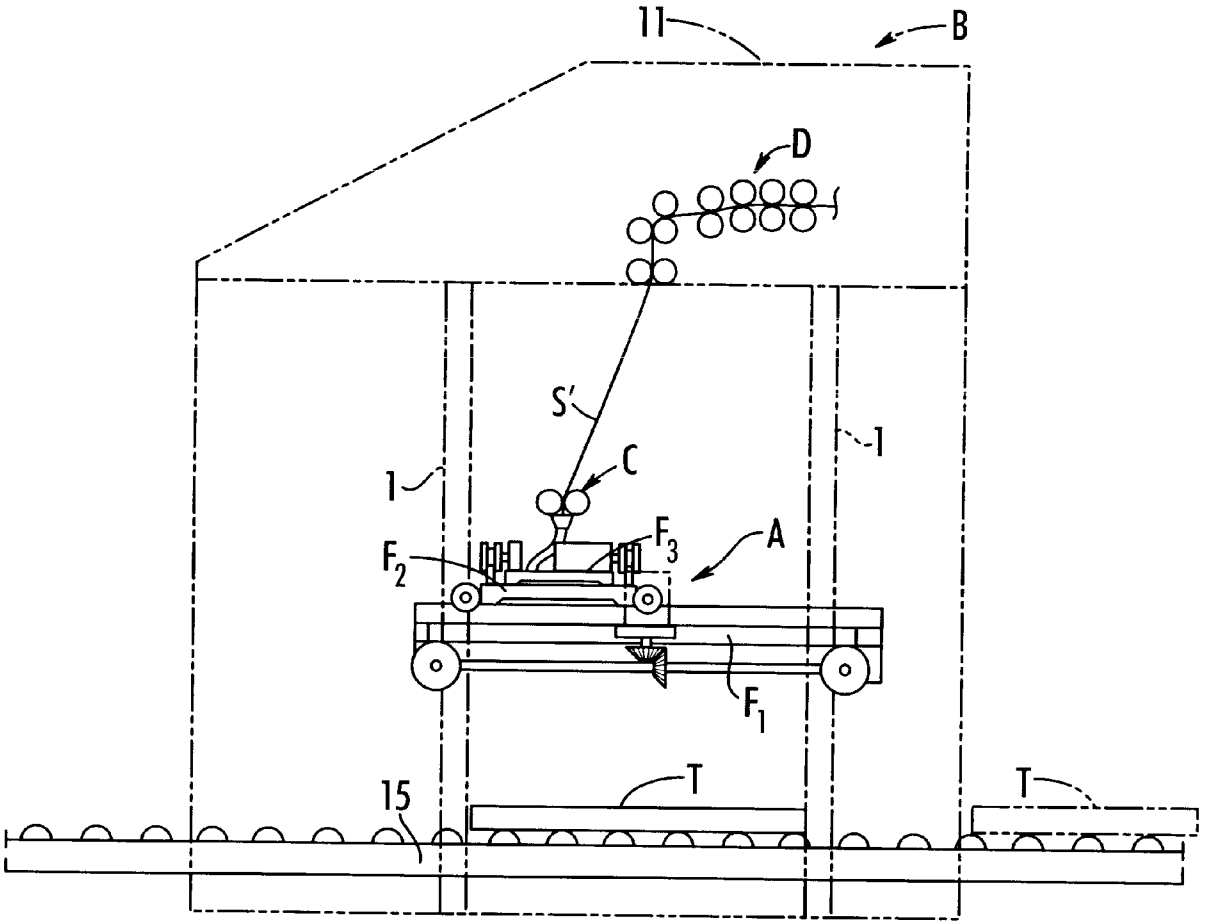
FIG. 3 is a right side view of accommodation device A.
Figure 4:
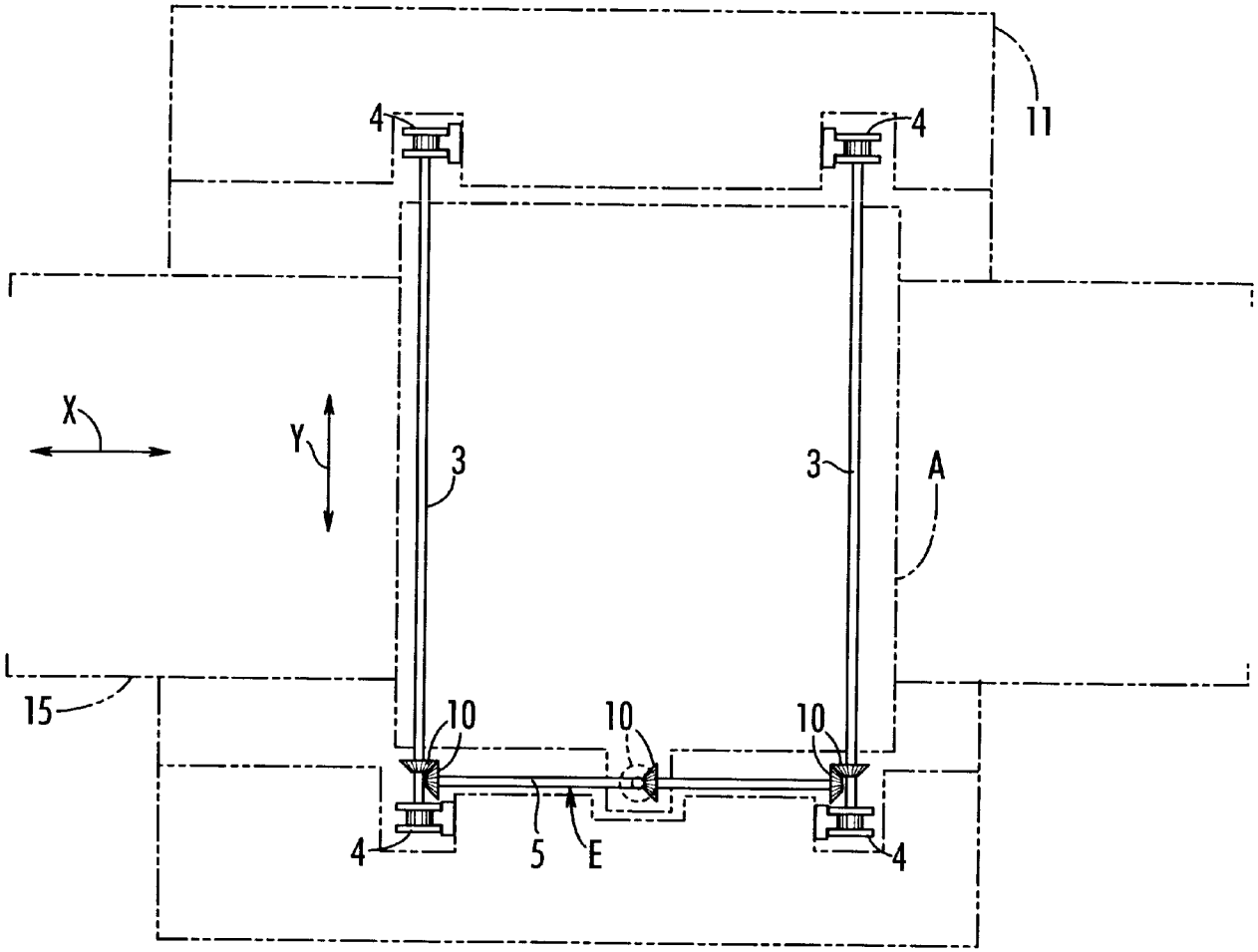
FIG. 4 is a top view of the driving force transmission system of upward and downward moving first motor $M_1$.

The following is a detailed description of the invention by showing the attached examples. FIG. 1 is the oblique disassembled drawing of the sliver accommodation device A. FIG. 2 is a top view of the device and FIG. 3 is a side view when viewed from the right side. FIG. 4 is a top view of the driving force transmission system of the first motor $M_1$ that is used for upward/downward motion. As shown in FIG. 1 and FIG. 4, the sliver accommodation device A is placed under the draft part D on the drawing frame and has a lifting/lowering capability. The sliver accommodation device A is equipped with three kinds of frames. The main frame $F_1$ is supported with 4 rack legs and is capable of being moved upward/downward (direction Z) by the first motor $M_1$. The second frame is a front/rear moving (direction X) inner frame $F_2$ operated by a second motor $M_2$ and supported by aforementioned frame $F_1$. The third frame, inner frame $F_3$, provides for right and left movement (direction Y) and it is operated by a third motor $M_3$ and supported by the aforementioned frame $F_2$.

A bracket 2 is installed at each bottom corner of the main frame $F_1$, and a pinion axis 3 is installed along the right and left direction Y at both ends. The aforementioned bracket 2 supports both ends of pinion axis 3. The pinion axes 3 have pinion wheels 4 located on each end. There are four rack legs 1, two located in front and two located in rear, the two front rack legs have racks on the front side while the two rear rack legs have racks on the rear side with which the aforementioned pinion wheel 4 will engage.

Also as shown in FIG. 1 and FIG. 4, the bevel gear axis 5 is installed on one side only of the main frame $F_1$ crossing with each of the above mentioned pinion axis at right angles, so that the driving force of the first motor $M_1$ provides for upward/downward motion, (motor $M_1$ which provides for this upward/downward motion is located to the upper center of bevel gear 5). The above mentioned driving force is transmitted in a crossing direction at right angles via bevel gear system E which consists of bevel gears 10. This driving force is then transmitted to the two pinion axes 3 which makes the pinion axes revolve. By this mechanism, the entire sliver accommodation device A is designed to lift/lower via the first motor $M_1$ forward or reverse revolution. Also a wire is linked to a balance weight (both not shown) to provide for smother lifting capability causing a smaller driving force to be exerted on the main frame $F_1$.

The front and rear moving rails 6 are installed on both ends right and left (direction Y) and each rail will run in the same direction as direction X. The front and rear moving inner frame $F_2$ has a rectangular shape with its width slightly shorter than the width of the frame $F_1$. A front/rear moving wheel 7, of which the axial center lays in the right and left direction Y, is installed on each corner of the inner frame $F_2$ and fits on the front/rear moving rails 6. The driving force from the second motor $M_2$ is connected directly to a designated wheel 7. The front and rear moving inner frame $F_2$ will move back and forth along the front and rear moving rails 6. Another pair of left/right moving rails 8 are installed in the direction Y at both ends of the front/rear moving inner frame $F_2$ in the direction of X.

The left/right moving inner frame $F_3$ has approximately the same width and a shorter length than the above-mentioned inner frame $F_2$. The left/right moving wheel 9 with its axial center laying in a front/rear direction, are installed on each corner of the left/right moving inner frame $F_3$. These left/right moving wheels 9 are fitted in a pair of the left/right moving rails 8 on the inner frame $F_2$, and the left/right moving inner frame $F_3$ will move to the left/right guided by a pair of left/right moving rails 8 moved by the driving force of the third motor $M_3$ directly connected to the designated wheel 9.

Figure 5:
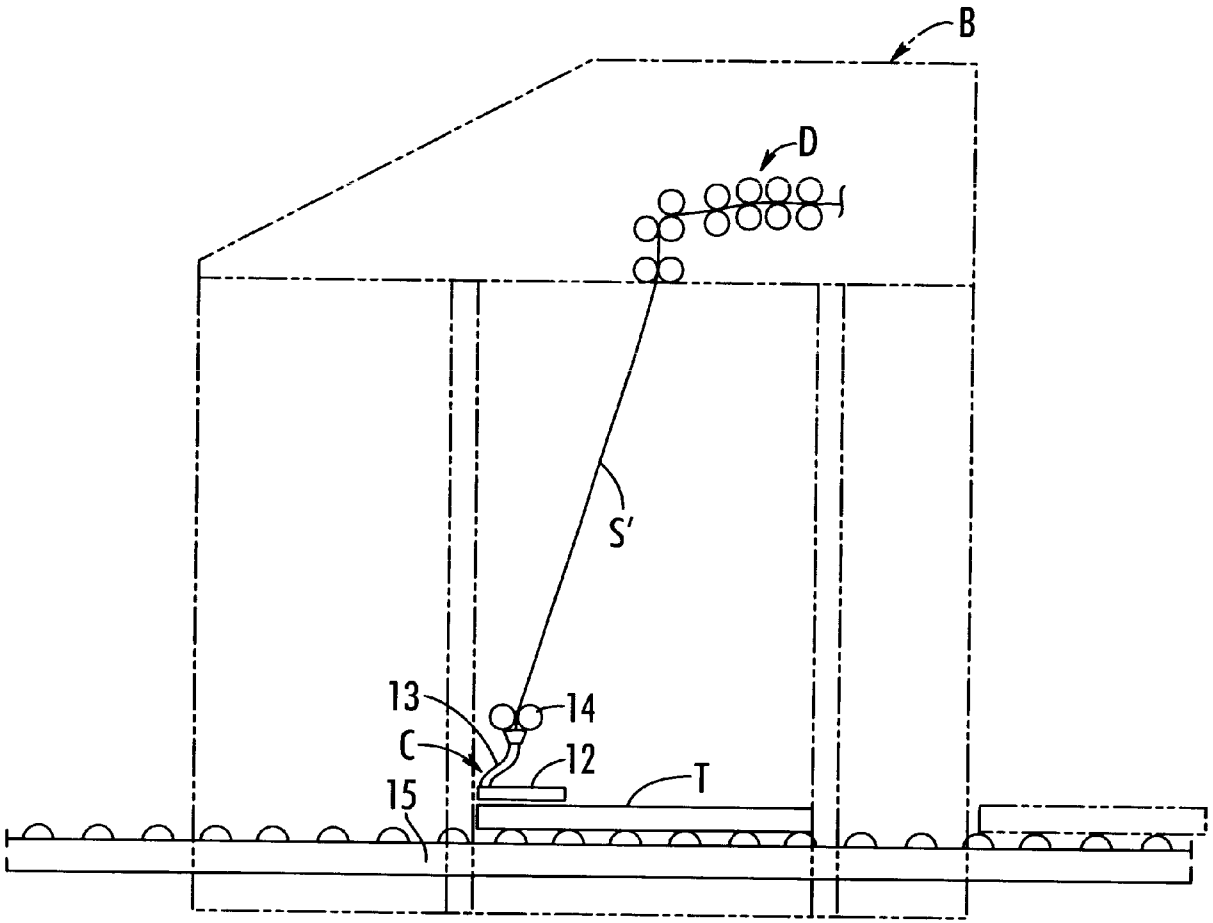
FIG. 5 is a side view of sliver S being loaded on the bottom layer.

The coiler system C, which was fixed to the drawing frame 11 at the downstream of the draft part D on the conventional drawing frame, was separated from the frame 11 and attached to the above-mentioned left/right moving inner frame $F_3$ instead. The coiler system C indicates the portion that consists of coiler plate 12, the coiler tube 13 on the upper stream, and a pair of nip rollers 14 as shown in FIG. 5. The coiler plate 12 and coiler tube 13, which comprise the revolving portion of the coiler system C, are controlled by a fourth motor $M_4$, the coiler revolving motor, the revolving motor is a control motor such as a servomotor. The coiler plate 12 and the coiler tube 13 can change revolution in harmony with the anging length of the sliver S (which is defined as the length of the sliver S coming down from the downstream of the draft part D to the nip rollers 14.). It is also controlled in such a way that the sliver S tension between the downstream of the draft part D and the nip rollers 14 does not change with the change of the sliver S hanging length, due to the coiler system C location change in relation to draft D.

Because the coiler system C is attached to the left/right moving inner frame $F_3$ apart from frame 11 of the drawing frame B, coiler system C is now able to move freely along with the entire sliver accommodation device A thus moving in three different directions that cross one another. These three directions are as follows; front/rear designated as direction X, left/right designated as direction Y, and upward/downward designated as direction Z controlled by three motors $M_1$, $M_2$ and $M_3$. A roller conveyor 15 is installed close to the floor of the drawing frame B stretching along in the direction that the sliver S is spinning out. The above-mentioned conveyor 15 can then transport an empty sliver tray T or a fully loaded sliver tray forward.

Additional explanation concerning how sliver S is accommodated on the sliver accommodation device A: when the sliver is continuously spun out of coiler system C which is installed on the sliver accommodation device A apart from drawing frame 11 of the draft part D, the sliver is accommodated in a loaded condition on the sliver tray T and placed on the transporting conveyor 15. First, as shown in the FIG. 5, the coiler system C is at the edge of the outer circle and at the height where the sliver S which is spun out of the coiler plate 12, can be loaded on the sliver tray T and be compressed with a designated pressure.

Figure 9:
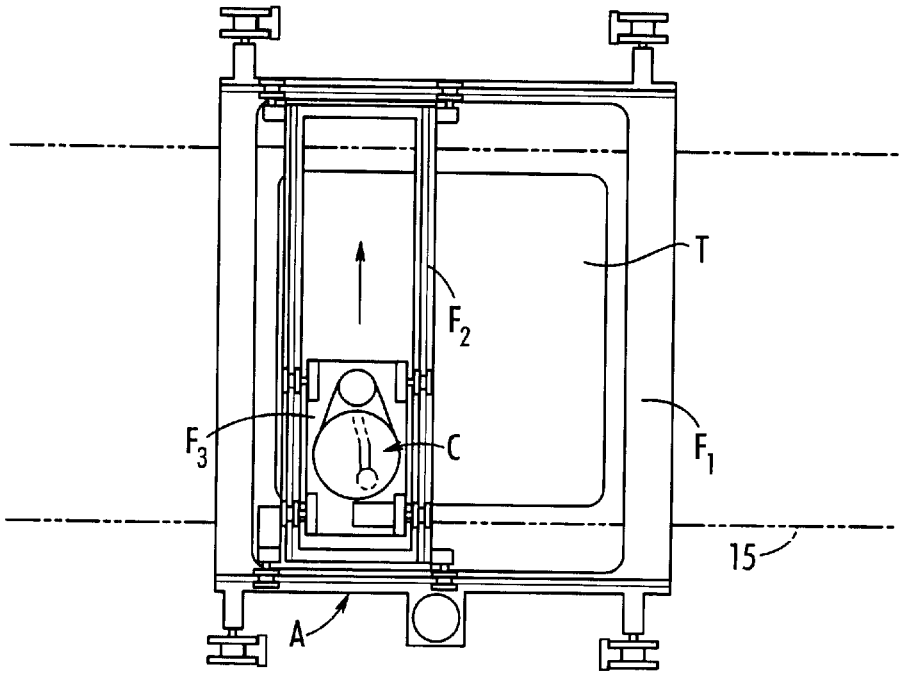
FIG. 9 is a top view of the sliver accommodation device A when the loading process is started.
Figure 10:
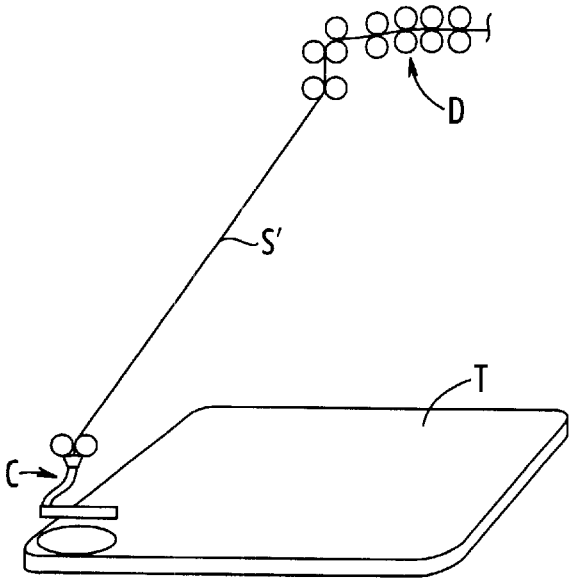
FIG. 10 is a typical oblique diagram.
Figure 11:
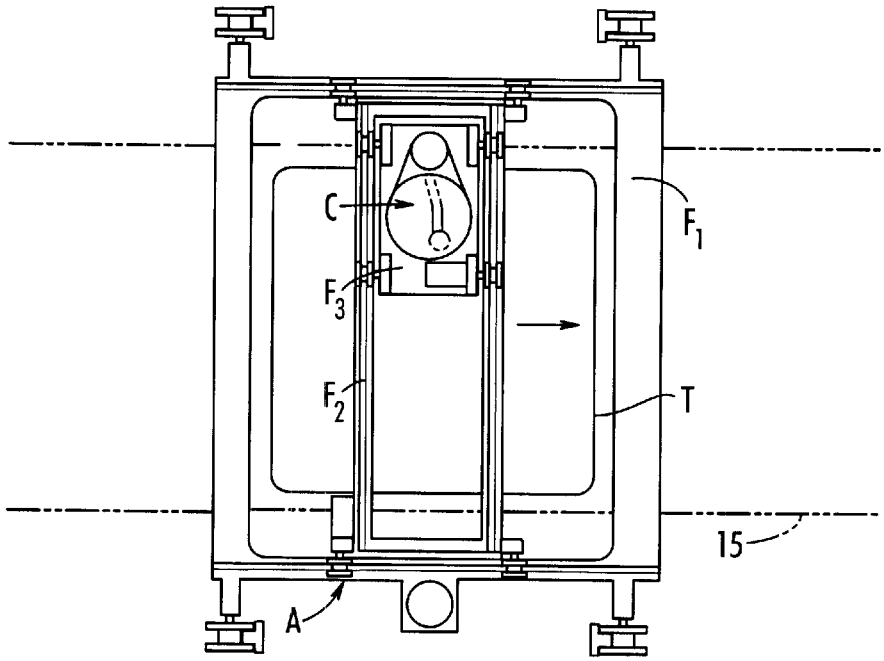
FIG. 11 is a top view of the accommodation device A in the process of loading sliver S on the bottom layer.
Figure 12:
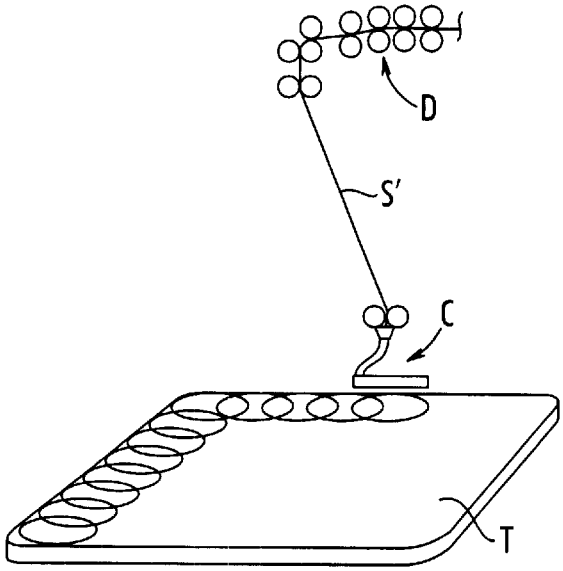
FIG. 12 is a typical oblique diagram.
Figure 14:
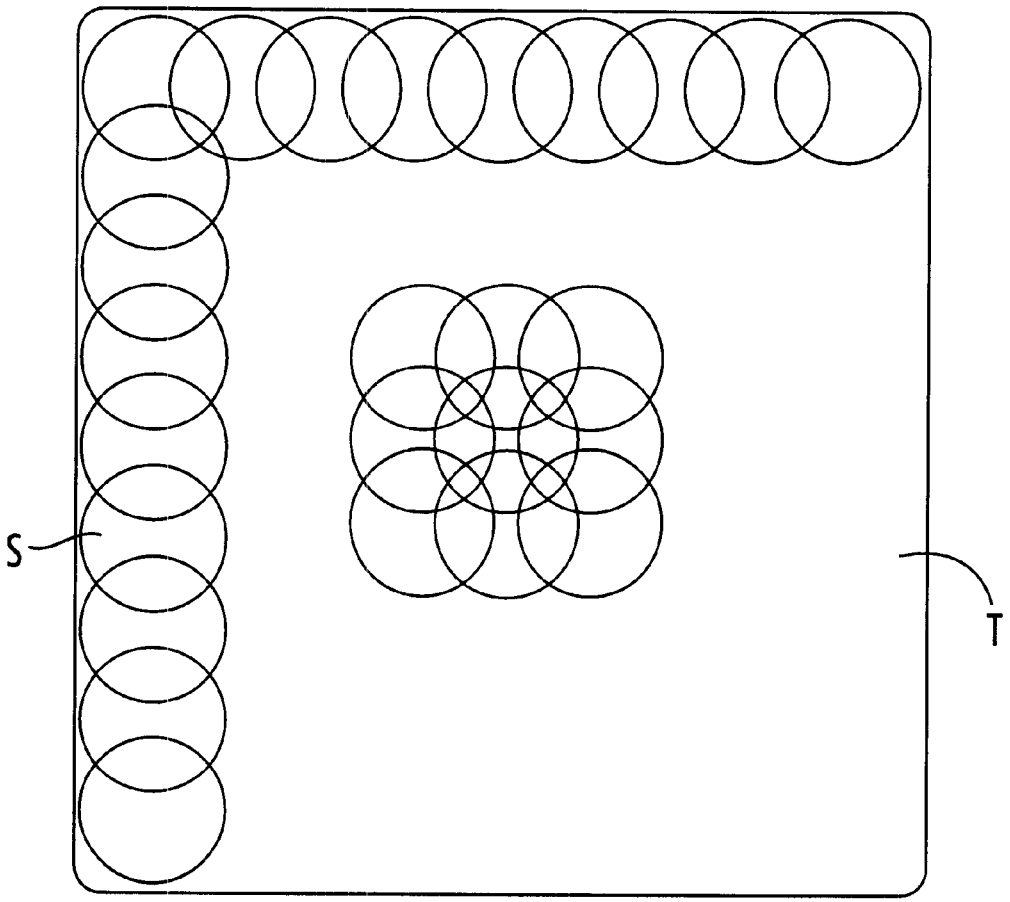
FIG. 14 illustrates the first locus caused by the coiler system C for sliver S loaded on the bottom layer on the sliver tray T.
Figure 15:
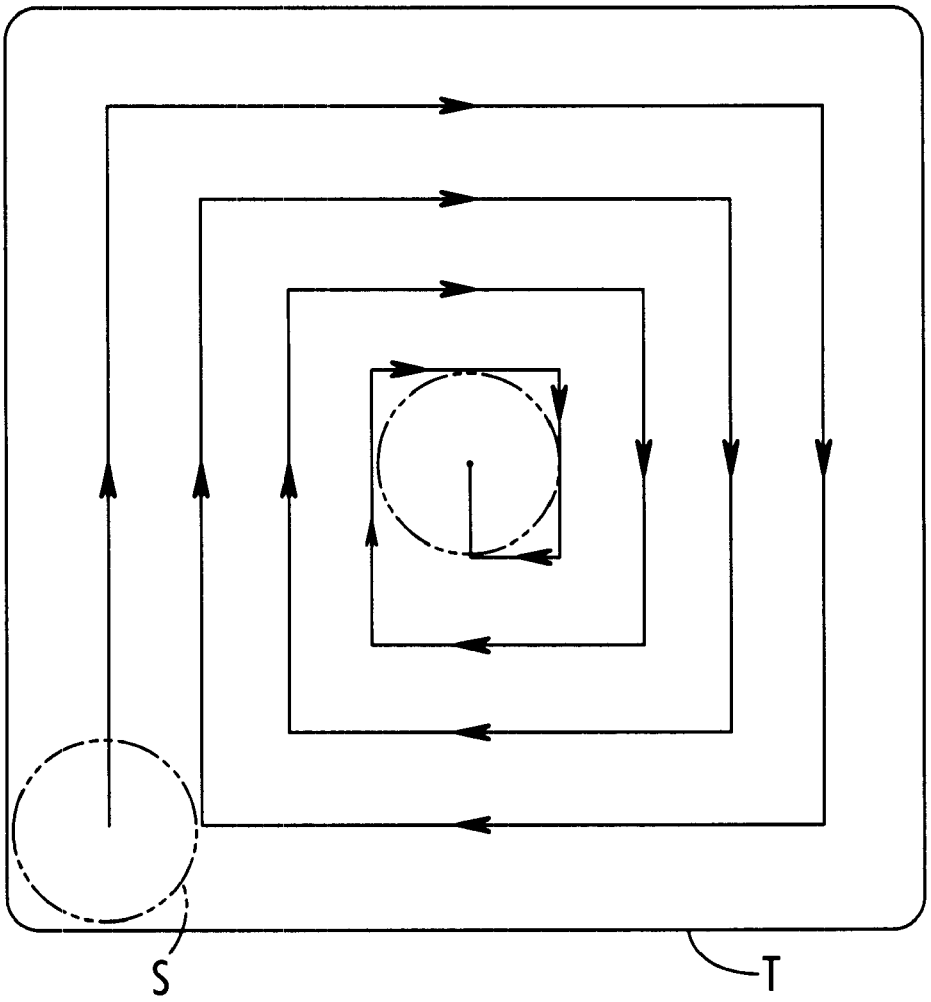
FIG. 15 illustrates the first locus of the coiler system C.

Set the main frame $F_1$ at a pre-designated height, then repeat two types of operations, an operation where the left/right moving inner frame $F_3$ moves in a left/right direction designated as Y on the inner frame $F_2$ while the front and rear moving inner frame $F_2$ is set not to move as shown in FIG. 9 and FIG. 10, and another operation where the front/rear moving inner frame $F_2$ moves in a front/rear direction X while the left/right moving inner frame $F_3$ is set not to move on $F_2$ as shown in FIG. 11 and FIG. 12. By repeating these operations alternately, the sliver S is loaded on the bottom layer of the sliver tray T by the coiler system C moving front/rear, and also left/right alternately. For example, to start the sliver S load from the outer circle of the bottom layer on sliver tray T, coiler system C starts loading the sliver S from the outer circle of the sliver tray T with the moving length of both left/right, and the moving length of both front/rear gradually getting shorter, and thus ultimately, it will cause the first locus (See FIG. 15) of the sliver S to be loaded on the center of the sliver tray T. FIG. 14 displays the sliver S loaded on the bottom layer of the silver tray T with the first locus drawn by coiler system C. It is showing the first locus drawn by the coiler plate 12 when the sliver S is loaded on the bottom layer. The hanging length of the sliver S changes every moment depending on the sliver S location to the sliver tray T, however, with the coiler revolving fourth motor M4, which is made to control the revolution in harmony with the change of the hanging length, the sliver S hanging portion is retained at a designated tension so as not to have either excessive slack or excessive tightness. Consequently, sliver S is spun out of the coiler plate 12 smoothly, and will be loaded on the sliver tray T.

Figure 16:
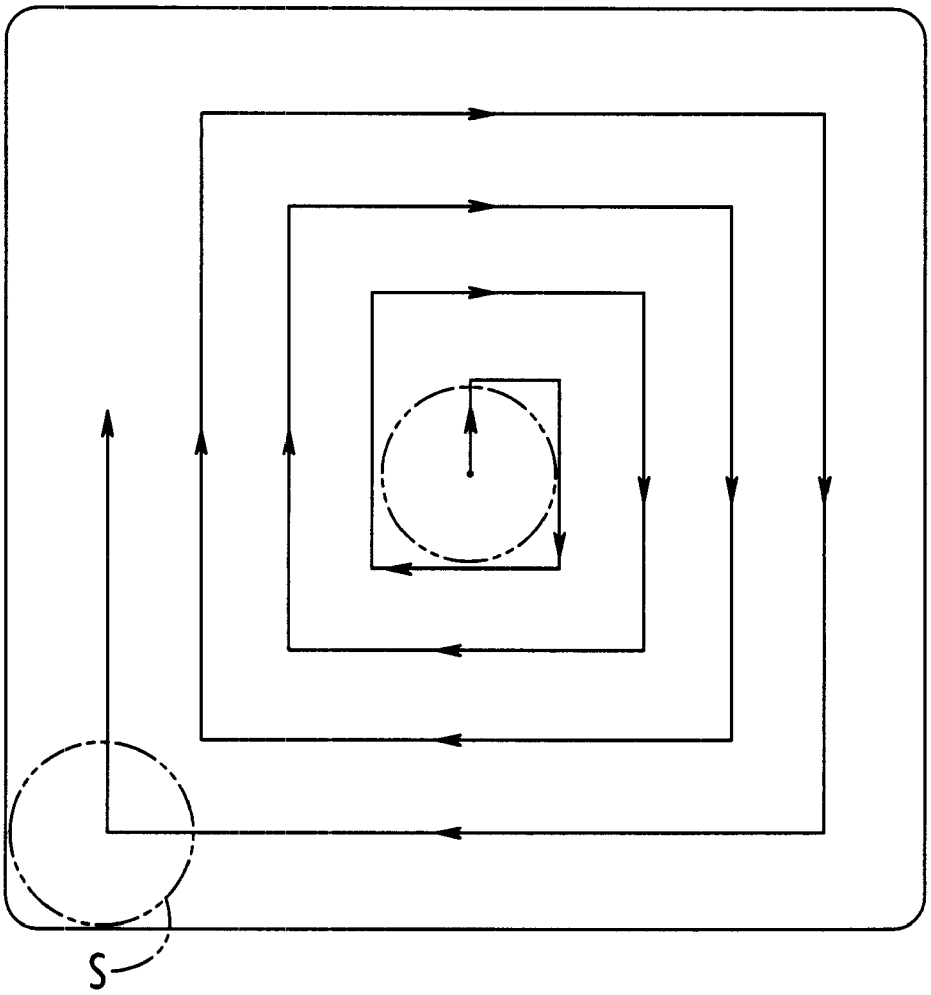
FIG. 16 illustrates the second locus of the coiler system C.

Bottom Layer: After the sliver S is loaded on the bottom layer on the sliver tray T, activate the upward/downward moving motor which is called the first motor M1 and then load the second layer of sliver S by lifting the entire sliver accommodation device to a designated height. Second Layer: In contrast, the coiler system C starts loading sliver S from the center of the sliver tray T on the second layer. By moving the front/rear moving inner frame F2 and the left/right moving inner frame F3 alternately, and by increasing the distance moved gradually, the coiler system C will cause the second locus (See FIG. 16) of the sliver S to be loaded on the outer edge of the sliver tray T. The maximum moving distance of the front/rear and of the left/right coiler movement by the coiler system C for the second layer will be slightly shorter than the one for the bottom layer.

Figure 6:
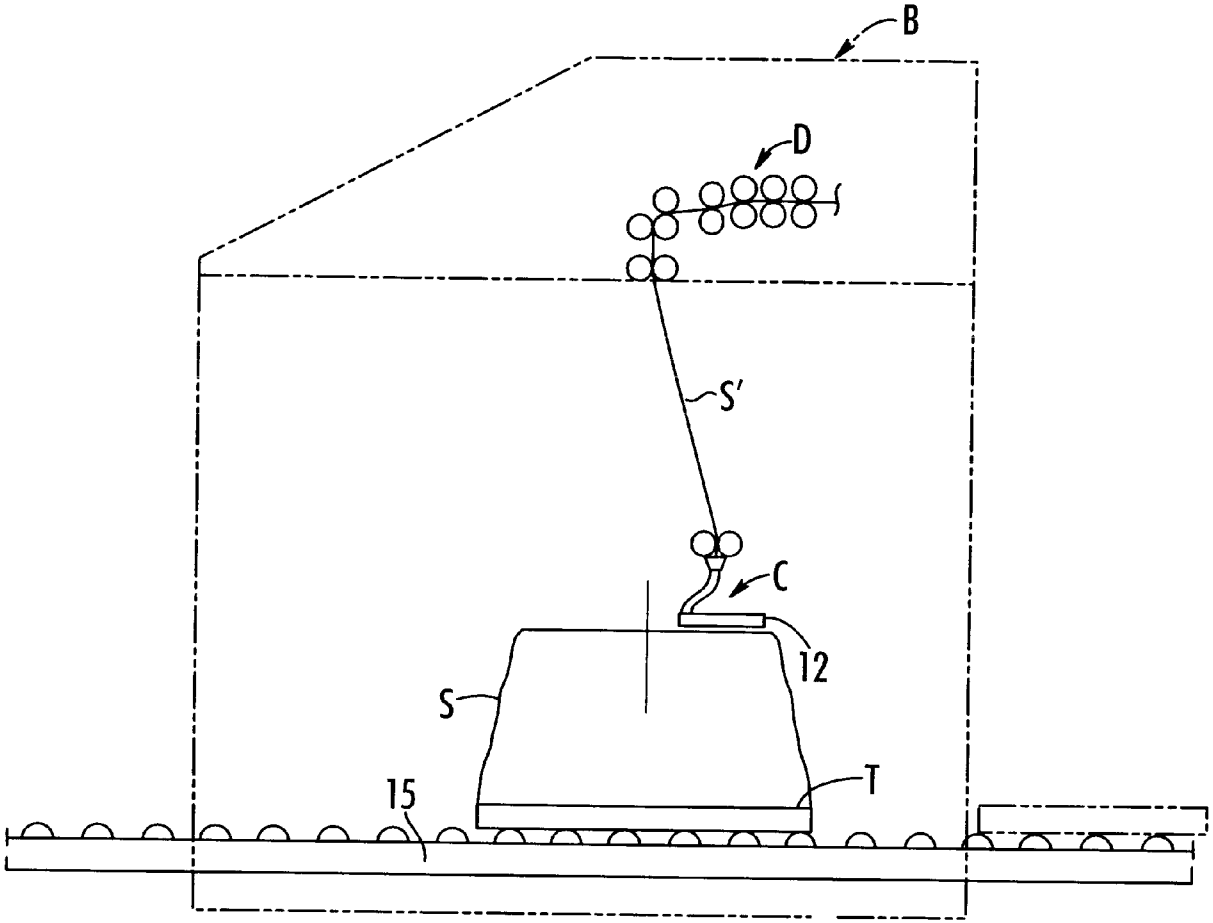
FIG. 6 is a side view of sliver S in the process of loading.
Figure 7:
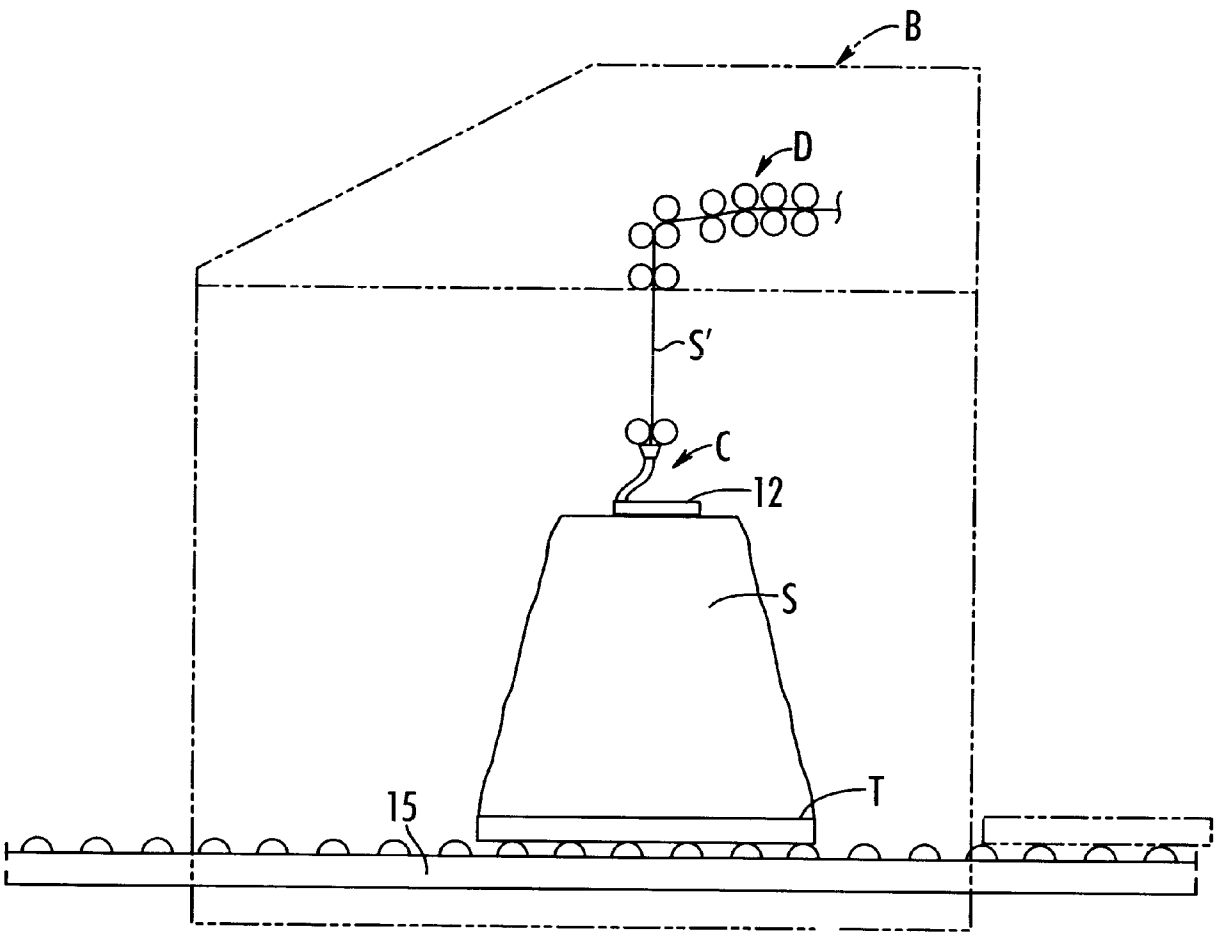
FIG. 7 is a side view of the sliver S when loading is complete.

After completing the procedure immediately above, the entire sliver accommodation device A will lift by a designated height every time, the coiler system C will form additional layers (ref. FIG. 6) by alternating the above mentioned locus 1 and the above mentioned locus 2 in a way that the maximum moving length of the front/rear, and the left/right length will gradually become shorter as each layer is added resulting in the loaded slivers S formation into a semi-truncated conical shape on the sliver tray T. (See FIG.

Figure 13:
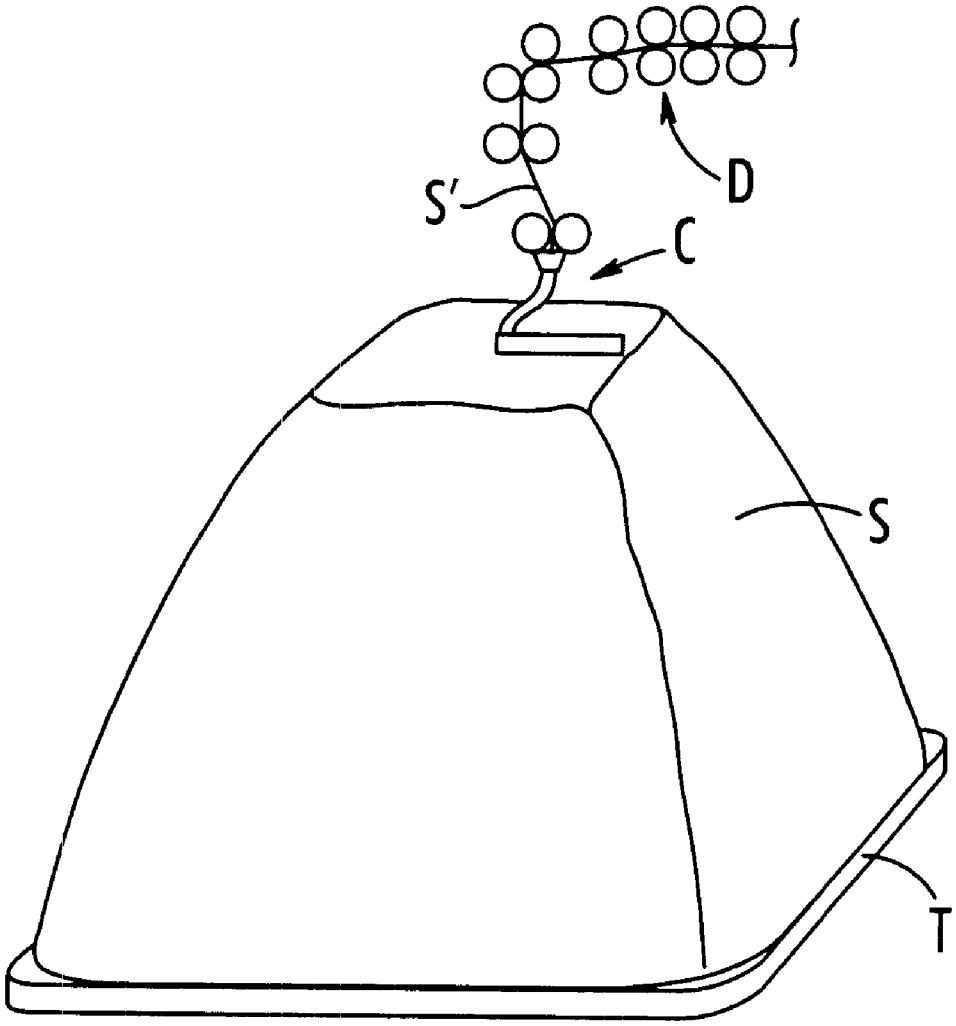
FIG. 13 is a typical oblique diagram of sliver S fully loaded on the sliver tray T.

7 and FIG. 13.) When the sliver S is being spun out, it will be loaded with a designated pressure against the already loaded sliver S, and because of the aforementioned truncated conical shape where each side is inclined at a designated degree, the sliver S will be able to be loaded on the outer edges without collapsing.

As additional layers are added, by changing the (front/rear, left/right movement), the maximum moving length will become shorter (gradual reduction degree of the maximum moving length), ultimately, the entire shape of loaded sliver S on the sliver tray T can be changed. For example, a gradual increase of the above mentioned maximum moving length will make the inclination on the sides of the loaded sliver S sharper and thus closer to a quadrangular shape and a gradual reduction of the above mentioned maximum moving length will make the sliver S become a quadrangular prism shape. Assuming that the spun out sliver S does not collapse, it becomes advantageous to have a smaller degree of gradual reduction with regards to the maximum movement length so as to load the sliver S into a quadrangular prism shape which will allow for a larger maximum load. Further more, by changing the moving speed of the loading coiler system C, for moving front/rear or left/right, the density of the loaded sliver S will be changed. In other words, reduction of the above mentioned speed will make the loaded sliver S density larger.

Figure 8:
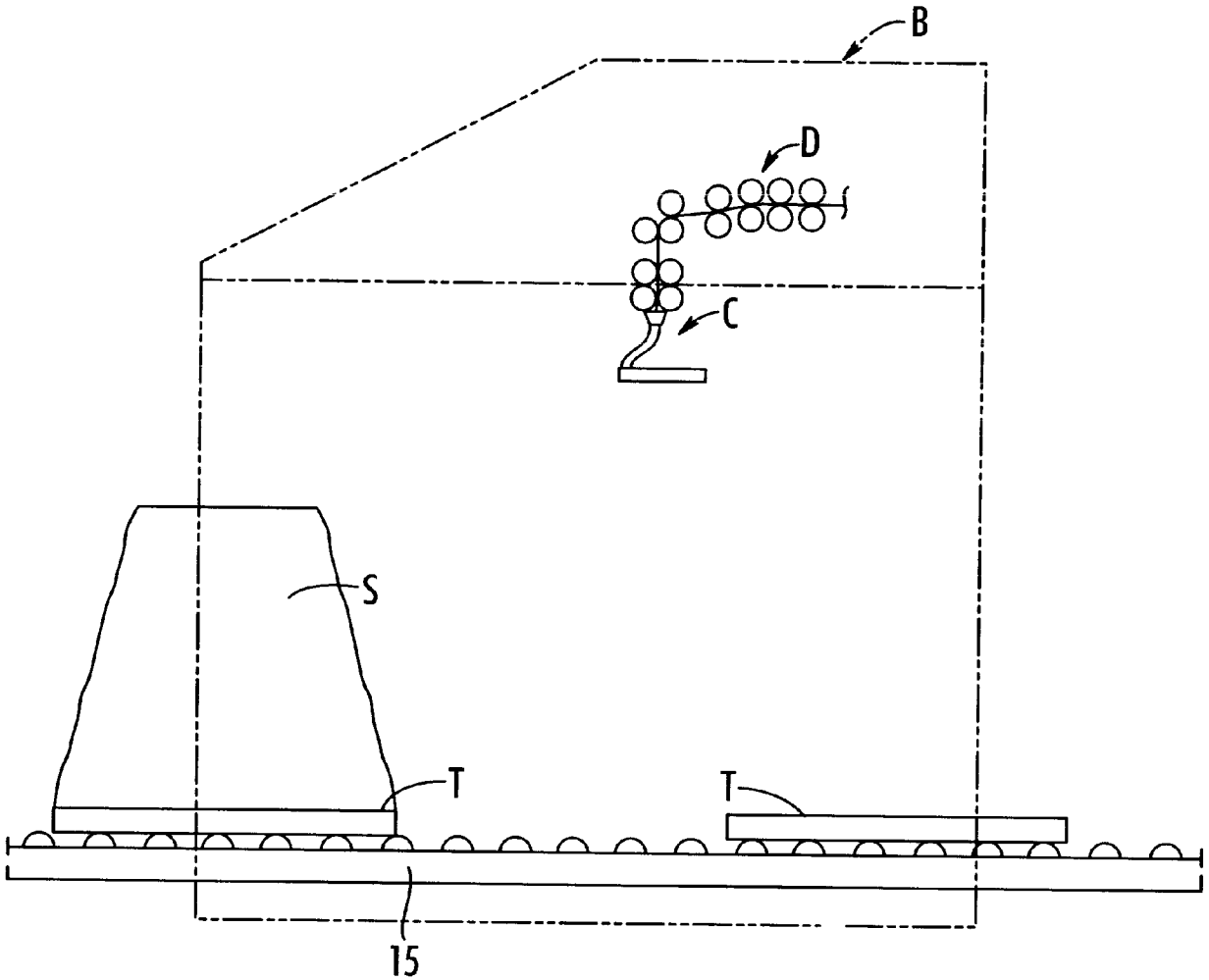
FIG. 8 is a side view of the loaded sliver S being transported.

As shown in FIG. 8, starting the first motor $M_1$ will lift the entire sliver accommodation device A to a maximum height, which will also lift the coiler system C to its highest point since it is also a part of the device. This action will then separate the coiler system C from the top of the loaded sliver S. Then the transporting conveyer 15 will start to move the loaded sliver S forward from the location directly underneath the previously lifted sliver accommodation device A so that the next empty sliver tray T can be brought directly under the sliver accommodation device A prepared and ready for the next accommodation of the loaded sliver S. This invention enables sliver spun out of a coiler system to be accommodated in a semi-truncated conical shape and loaded onto the sliver tray, which was already placed in a designated location. The device enables the accommodation of sliver in a semi-truncated conical shape capable of standing independently and without requiring the use of spindles. The coiler system was removed from the drawing frame so that the device is able to move front/rear, left/right, and also upward/downward. These three directions can cross one another. As a result, the spindles which were once needed as a requirement for this process will no longer be required resulting in a cost benefit to the buyer. The initial cost needed to purchase the spindles will be reduced. Further, the sliver can be accommodated with less energy compared to the use of spindles. An additional advantage is that the empty sliver trays are stackable for storage, which can save considerable space compared to the space needed for storing empty spindles.

The invention as disclosed herein is subject to various modifications and variations as will be seen by those of ordinary skill in the art. The invention is therefore not limited solely to the method and apparatus specifically described, but is intended to have the scope as set forth in the following claims.

What is claimed is:

1. A sliver accommodation method, comprising:

receiving said sliver upon a sliver receiving tray from a coiler system;

moving said coiler system up and down;

moving said coiler system left and right; and moving said coiler system forward and backward, to accumulate sliver into layers with a pre-determined pressure against previously received sliver forming a semi-truncated conical shape of sliver.

2. A sliver accommodation apparatus comprising:

a coiler system attached to a frame;

a sliver receiving tray for receiving sliver;

first driving means for moving said coiler system up and down;

second driving means for moving said coiler system left and right; and third driving means for moving said coiler system forward and backward;

whereby said sliver is accumulated into layers having pre-determined pressure against previously received sliver, said layers forming a semi-truncated conical shape.

3. A sliver accommodation apparatus comprising:

a frame comprising a first frame component and a second frame component wherein said second frame component is slidably attached to said first frame component and capable of moving in a first direction;

a coiler system slidably attached to said second frame component and capable of moving in a second direction different from said first direction; and a sliver plate for receiving a sliver from said coiler system wherein said coiler system moves in said first direction and said second direction as said sliver plate receives said sliver.

4. The sliver accomodation apparatus of claim 3 wherein said first direction and said second direction are perpendicular.

5. The sliver accomodation apparatus of claim 4 wherein said first direction and said second direction are parallel to said sliver tray.

6. The sliver accomodation apparatus of claim 3 further comprising a lifting mechanism for raising and lowering said frame.

7. The sliver accomodation apparatus of claim 3 wherein said coiler system moves in said first direction for a duration and then moves in said second direction for a second duration.

8. A method for collecting sliver on a tray comprising:

receiving sliver in a coiler system wherein said coiler system comprises:

a lift mechanism for raising and lowering said coiler system;

a first translation mechanism for moving said coiler system in a first linear direction perpendicular to said raising and lowering; and a second translation mechanism for moving said coiler system in a second linear direction perpendicular to said raising and lowering;

passing said sliver from said coiler system to a sliver tray forming a loaded sliver;

repositioning said coiler system by:

moving said coiler in said first linear direction for a first predetermined distance while passing said sliver;

moving said coiler in said second linear direction for a second predetermined distance while passing said sliver; and raising said coiler system;

repeating said repositioning until a predetermined amount of sliver has been collected on said sliver tray; and terminating said passing.

9. The method for collecting sliver on a tray of claim 8 wherein said loaded sliver forms a truncated quadrangular prism.

10. The method for collecting sliver on a tray of claim 8 wherein said loaded sliver forms a semi-truncated cone.

11. The method for collecting sliver on a tray of claim 8 further comprising prior to said terminating:

repositioning said coiler system by:

moving said coiler in said first linear direction for a third predetermined distance while passing said sliver; and moving said coiler in said second linear direction for a second predetermined distance while passing said sliver, raising said coiler system.

12. The method for collecting sliver on a tray of claim 11 wherein said third predetermined distance is less than said first predetermined distance.

13. The method for collecting sliver on a tray of claim 11 wherein said fourth predetermined distance is less than said second predetermined distance.

14. A sliver accommodation method, comprising:

receiving said sliver from a coiler system;

moving said coiler system up and down;

moving said coiler system left and right; and moving said coiler system forward, to accumulate sliver into layers.

15. A sliver accommodation apparatus comprising:

a coiler system attached to a frame;

a sliver receiving tray for receiving sliver;

first driving means for moving said coiler system up and down;

second driving means for moving said coiler system left and right; and third driving means for moving said coiler system forward and backward;

whereby said sliver is accumulated into layers.

* * * * *